United States Patent [19]

Outlaw

[11] 4,181,071

[45] Jan. 1, 1980

[54] MODIFIABLE RECEPTACLE TEAPOT

[76] Inventor: Jeanette M. Outlaw, 423 St. James Ave., Suffolk, Va. 23434

[21] Appl. No.: 893,043

[22] Filed: Apr. 3, 1978

[51] Int. Cl.[2] ..... A47J 31/18

[52] U.S. Cl. ..... 99/317; 99/323; 126/348

[58] Field of Search ..... 99/287, 290, 293, 306, 99/316, 317, 321, 322, 467, 323; 126/348, 369

[56] References Cited

U.S. PATENT DOCUMENTS

| | | | |
|---|---|---|---|
| 859,623 | 7/1907 | Smith | 126/369 |
| 916,327 | 3/1909 | Kingsbury | 99/290 |
| 2,591,606 | 4/1952 | Reed | 99/316 |
| 2,932,293 | 4/1960 | Rassieur | 126/369 |
| 4,027,582 | 6/1977 | O'Connell | 99/306 |

*Primary Examiner*—Robert W. Jenkins
*Attorney, Agent, or Firm*—J. M. Carson, Jr.; Prince Butler; William F. Frank

[57] ABSTRACT

This disclosure describes a teapot and a cover therefor. The cover is hollow and radiused at the top tapering to a slightly larger radius at the bottom. The hollow cover is sufficiently large and operates as a food warmer when the perforated disc is placed across the opening of the tea making chamber. The perforated disc allows the penetration of steam into the hollow cover of the teapot creating a food warmer, thus conserving energy by making use of otherwise unused steam. The teapot having a removable circular band, with attached teabag holders, which fits within the interior of the tea making chamber is of a size slightly less than the interior diameter of the tea making chamber and allows for use of the standard teabag without the string and label being attached, thus eliminating the teabag string from falling into the infusing substance during the infusing process and further eliminating the dangers of the teabag label coming in direct contact with the heating source.

1 Claim, 4 Drawing Figures

MODIFIABLE RECEPTACLE TEAPOT

BACKGROUND OF THE INVENTION

Teapots which are presently manufactured presuppose that the user wishes to heat the infusing substance in the teapot and that the infusing agent, such as the teabag, is located in another container in which said infusing substance is then poured causing a brewing action upon contact with the infusing agent. It is however, a present, a more common and economical practice to place the infusing agent directly in the teapot for brewing. In situations where an infusing agent such as the standard teabag, with its's accompaning string and label, is used, the label oftentimes becomes charred from the flame or heat of the apparatus used for heating the infusing substance. The string oftentimes falls into the infusing substance and has to be retrieved with a kitchen utensil. The present invention, wich comprises a circular band which fits into the interior of the tea making chamber, eliminates these occurrences inasmuch as it provides holders for the teabags which are designed in such a manner as to allow the user to remove the label and string from the standard teabag and place it in the teabag holding device.

In an attempt to conserve energy and maximize the efficiency of the teapot, it has been proposed to form a hollow cover and a perforated disc which fits across the opening of the tea making chamber. With this construction, the perforated disc will allow steam to penetrate into the hollow cover and yet will not allow solid particles to come in contact with the infusing substance. As such, bread and the like may be placed on the perforated disc to be warmed. The perforated disc can equally be made of any material which allows for the penetration of steam into the cover whicle retaining solids.

Other features of this invention include a filter which traps solid particles which escape from the infusing agent which might otherwise ultimately end up in the drinker's cup, and a handle which is designed to be positioned so as to avoid close contact with the source of heat while the infusing process is taking place.

The invention, both as to its organization and method of operation together with further features and advantages thereof may best be understood by reference to the following description taken in connection with the accompaning illustrative drawings.

Figure 1:
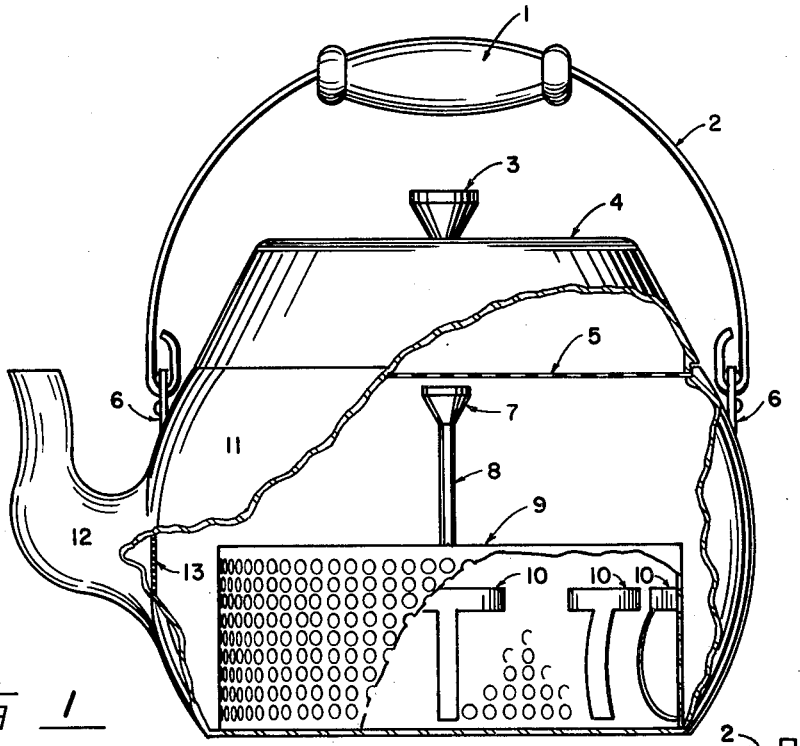
FIG. 1 is a sectional elevational view of the container made in accordance with the present invention, the container being partially broken away to show the construction thereof.

Referring now more particularly to the drawings, it will be seen in FIG. 1 that the body of the container 11 is sperically shaped. The top rim of the container 11 has a lip that petrudes inwardly so as to provide support for the flat perforated disc 5 which fits across the top of the container 11. The spout 12 is smaller in diameter at the top than at the bottom and is attached to the container 11. A filter 13, which is a flat piece of perforated metal, covers the opening in the lower portion of the spout 12. The cover 4 is radiused at the top tapering to a slightly larger radius at the bottom with a lip on the inside edge so as to hold itself in position when the container 11 is tilted. A conical shaped knob 3 is provided to facilitate manipulation of the cover 4. A handle 2 with an accompaning knob 1 is provided on the body of the container 11, such handle 2 being shown here attached to a bracket 6 which is attached to the exterior of the container 11, though it is to be understood that any form of handle may be used to assist in manipulating the body of the container 11. The bracket 6 is illustrated in detail in FIG. 2. Internally of the container 11, there is a teabag holding device which is illustrated in detail in FIG. 3.

Figure 2:
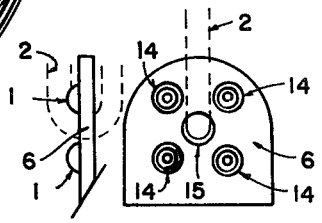
FIG. 2 is an elevational view of the handle with an attendant side view of same.

FIG. 2 illustrates a bracket 6 made of a piece of flat metal with a slight arc at its base to fit the contour of the container 11. The top portion of the bracket 6 is radiused forming a half circle. At the center point of the half circle is a small opening 15 to receive the handle 2. At forty-five degree angles from the center point of the bracket 6, equally spaced to form a square, are four nipples 14 stamped into the metal bracket 6. The nipples 14 are provided to allow the user to place the handle 2 in the desired position while at the same time keeping the handle 2 as far away from the source of heat as possible. The two ends of the handle 2 shall be formed in an elliptical shape with the inner short radius not to exceed the thickness of the bracket 6 and nipples 14 so as to allow the handle 2 to be held in the desired position by the nipples 14.

Figure 3:
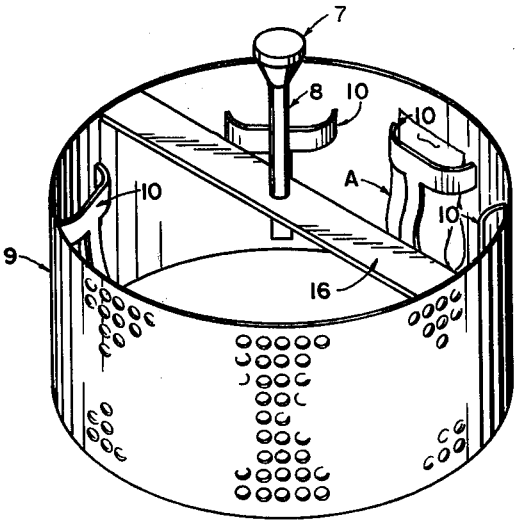
FIG. 3 is a perspective view of the perforated circular band and attached teabag holders made in accordance with the present invention.

FIG. 3 is an illustration of a teabag holding device which has been designed to fit within the interior of the container 11. The device consists of a circular shaped perforated band 9 with several receptacles 10 for the infusing agent A. Attached to the perforated band 9 is a flat rectangular shaped strip 15 with a cylinder shaped extension 8 and a conical shaped knob 7 which extends vertically. Attached to the inner walls of the circular band 9 are several "T" shaped receptacles 10 for the infusing agent A. The horizontal portion of the "T" shaped receptacle 10 is flat in the middle and turned inwardly on the ends so as to attach to the circular band 9. The verticle portion of the "T" shaped receptacle 10 is radiused from the horizontal portion. The bottom of the vertical portion of the "T" shaped receptacle 10 petrudes outwardly from the circular band 9 so as to allow for the flow through action of the teabag. The expansion of the teabag during the infusing process prevents the teabag A from moving out of the receptacle 10. The circular band 9 is easily removed from the interior of the container 11 with the aid of the vertical rod 8 and knob 7.

Figure 4:
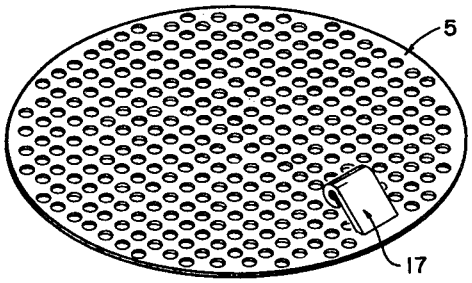
FIG. 4 is a perspective view of the perforated disc made in accordance with the present invention.

FIG. 4 is an illustration of the perforated disc 5 which fits across the opening of the container 11. The disc 5 is a flat piece of perforated metal, circular in shape so as to fit directly on top of the lip which petrudes inwardly from the opening of the container 11. For removal of the perforated disc 5, a piece of flat metal 17 rolled on one end and welded to the perforated disc 5, is provided.

Obviously, other variations and modifications of the present invention are possible in the light of the foregoing teachings. It is therefore to be understood that within the scope of the appended claims the invention may be practiced otherwise than as specifically described.

What is claimed as new and desired to be secured by Letters Patent of the United States is:

1. A teapot including a tea making chamber having a teabag holding device operationally disposed therein, said teabag holding device being substantially circular in shape and having a substantially cylindrical operationally vertically disposed side wall, said side wall of said teabag holding device carrying a plurality of T-shaped teabag receptacles, each of said teabag receptacles including a horizontal portion having a central section spaced from said side wall of said teabag holding device and end sections each interconnecting said central portion thereof and said side wall of said teabag holding device, each of said teabag receptacles further including a vertical portion having an upper section interconnected with said central section of said horizontal portion thereof spaced from said side wall of said teabag holding device and a lower section interconnecting said upper section thereof and said side wall of said teabag holding device.

* * * * *